United States Patent [19]

Heimburg

[11] Patent Number: 4,805,567

[45] Date of Patent: Feb. 21, 1989

[54] VALVE MECHANISM FOR AT LEAST TWO SIMULTANEOUSLY ACTUABLE VALVES

[75] Inventor: Fritz Heimburg, Nauheim, Fed. Rep. of Germany

[73] Assignee: General Motors Corporation, Detroit, Mich.

[21] Appl. No.: 71,789

[22] Filed: Jul. 10, 1987

[30] Foreign Application Priority Data

Jul. 17, 1986 [DE] Fed. Rep. of Germany ..... 3624108

[51] Int. Cl.[4] ..... F01L 1/26

[52] U.S. Cl. ..... 123/90.22; 123/90.28; 123/90.48; 123/90.55

[58] Field of Search ..... 123/90.22, 90.28, 90.48, 123/90.55

[56] References Cited

U.S. PATENT DOCUMENTS

| | | | |
|---|---|---|---|
| 2,925,808 | 2/1960 | Baumann | 123/90.48 |
| 3,712,277 | 1/1973 | Piatti | 123/90.22 |
| 4,007,716 | 2/1977 | Jones | 123/90.48 |

FOREIGN PATENT DOCUMENTS

| | | | |
|---|---|---|---|
| 61-49114 | 3/1986 | Japan | 123/90.6 |

*Primary Examiner*—Andrew M. Dolinar
*Attorney, Agent, or Firm*—Robert J. Outland

[57] ABSTRACT

A pair of adjacent valves (intake or exhaust) are operated by a single cam lobe on an engine camshaft via a bucket tappet, the arrangement being such that both the bucket tappet and the valves are rotatable during engine operation to reduce wear thereof. Preferably, a hydraulic lash adjuster is operatively associated with the bucket tappet and with a thrust member engaging the free stem ends of the valves.

4 Claims, 3 Drawing Sheets

VALVE MECHANISM FOR AT LEAST TWO SIMULTANEOUSLY ACTUABLE VALVES

FIELD OF THE INVENTION

The invention relates to a valve mechanism for at least two simultaneously actuable valves of an internal combustion engine, including one thrust member which is operatively associated with all valves and adapted to be displaced by a camshaft, and which has the valve stems of the valves bearing thereagainst.

PRIOR ART

A valve mechanism of the above type has been disclosed in German Offenlegungsschrift DE-OS No. 33 44 324. In this prior art valve mechanism, the thrust member is in the form of a single thrust plate which is axially guided in the cylinder head and which is engaged on the one side thereof by a pair of cams and on the other side thereof by the ends of a pair of valve stems. Since in this arrangement the cams of the camshaft are moving in the same sense of rotation, the one cam has the tendency to turn the thrust member in one direction and the other the tendency to turn it in the opposite direction. This means that because of the manner in which the thrust member is actuated by the cams, it is not possible for the thrust member to be rotated. However, since the thrust member used in the arrangement according to German Offenlegungsschrift No. DE-OS 33 44 325 is guided in axial direction, its service life could be extended if it were possible to rotate it a fraction of a turn each time it is actuated, because this would improve lubrication and ensure uniform wear. Moreover, it would also be desirable if rotation of the valves could be effected in a relatively simple manner.

The above-mentioned Offenlegungsschrift also describes an automatic valve clearance compensating mechanism which is effective in eliminating valve play, so that valve adjustment service operations become unnecessary. However, the automatic valve clearance mechanism described in the above-mentioned German Offenlegungsschrift does not have the capability of turning the thrust member or the valves. In fact, in the embodiment described in the above-mentioned German publication No. DE-OS 33 44 324 that features the valve clearance compensating means, the thrust device even includes a thrust member which has a balance beam configuration and which, since it is guided in the cylinder head, is not circular and is therefore not suitable for turning movement during valve actuation.

The invention contemplates providing a valve mechanism of the type described above which enables, in a relatively simple manner, the thrust member and, at the same time, the valves to be axially rotated a fraction of a turn each time they are actuated by the cams.

OBJECTS OF THE INVENTION

This object is accomplished in a simple manner in that the camshaft is provided with one single cam which engages the thrust member eccentrically, in that the thrust member is axially symmetrical, and in that the valve stems 7, 8 are bearing against the thrust member 11 in such a manner that engagement occurs at a point outside their axial center line.

THE INVENTION

This arrangement will provide that the cam of the camshaft applies a torsional moment onto the thrust member about the longitudinal axis thereof each time the valves are being actuated whereby a slight turning movement of the thrust member is effected. The thrust member in turn will, because of its off-center engagement with the valve stems, impart slight rotational movement onto these valve stems. This will accomplish to increase, with a minimum of cost and complexity, the service life of the valves and that of the thrust member.

If the valve mechanism is to be provided with hydraulic self-adjusting tappets, an advantageous arrangement is one wherein the thrust member is comprised of a bucket-type tappet which is bearing against the cam of the camshaft and is axially guided in a wall of the engine, and of a thrust plate which is arranged below the bucket-type tappet, and wherein the valve clearance compensating means is arranged intermediate the bucket-type tappet and the thrust plate, and wherein, furthermore, the thrust plate has a central cup-shaped portion which engages a correspondingly contoured dome-shaped portion of the valve-clearance compensating member.

An arrangement of this type is very compact. The spherical surfaces permit slight pivoting movement of the thrust plate so that compensation can be made for tolerances that may exist in the valves to be actuated.

According to another relatively simple and space-conserving arrangement, the valve clearance compensating device includes two pistons which are telescopically fitted one within the other and which have a high-pressure chamber arranged therebetween. The upper piston is bearing against the inner surface of the end wall of the bucket-type tappet, and the lower piston is provided with the dome-shaped end face which is in engagement with the cup-shaped surface of the thrust plate. Furthermore, this modified embodiment also includes an oil reservoir chamber which is arranged in the space between the outer side of the dual piston assembly and the inner wall surface of the bucket-type tappet and which is in communication, by way of a check valve, with the high-pressure chamber between the two pistons.

If the valve mechanism according to the invention is intended for use with two valves that are spaced relatively far apart from each other, it is advisable that the thrust plate have a hat-like configuration, that it have a brim-like edge which extends radially outwardly from the bucket-type tappet, and that the thrust plate engage the valve stems through this flange.

It should be appreciated that a variety of arrangements may be utilized in the practice of this invention. To convey the concept of the invention, three exemplary embodiments are illustrated in the drawings and are described in the following.

DESCRIPTION

Figure 1:
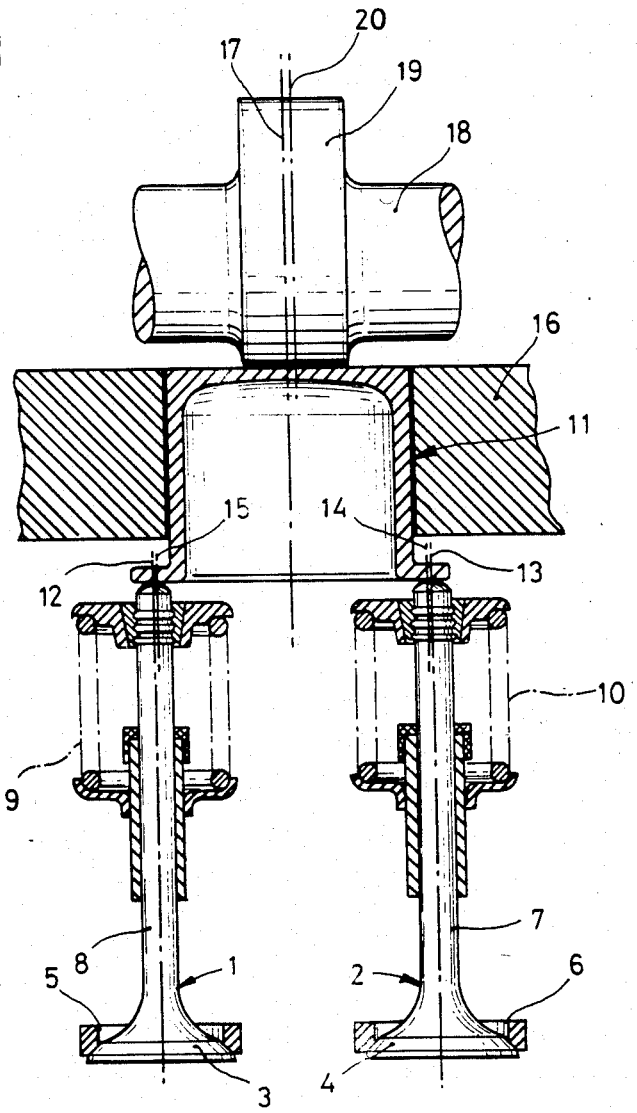
FIG. 1 is a longitudinal section of a valve mechanism according to the invention.

FIG. 1 illustrates a pair of parallel valves 1, 2 with respective valve heads 3, 4 which are bearing from below against valve seats 5, 6, respectively. Each valve 1, 2 has, as is usual, valves stems 7, 8, respectively, which are biased, by means of return springs 9, 10, in the valve closing direction.

The two valve stems 7, 8 have their respective end faces bearing against a single thrust member 11 which is shared by both valves 1, 2 and which, in this embodiment, is in the form of a bucket-shaped member. One salient feature of the invention is that the end faces of the valve stems 7, 8 ar engaging the thrust member 11 outside the longitudinal axes 12, 13 of the valve stems 7, 8. To illustrate this feature, lines 14, 15 which are extending through the respective points of engagement, have been inserted into the drawing.

The thrust member 11 is mounted in a wall 16 of the internal combustion engine (not shown) and is adapted for axial displacement and rotary movement about its axis. On top of the thrust member 11 there is mounted a camshaft 18 having a cam 19 which engages the upper end face of the thrust member 11. Here, too, the axial center line of the thrust member 11 is offset with respect to the center line denoted by the numeral 20.

When the camshaft 18 is turning, the cam 19 will urge the thrust member 11 downwardly. This downward movement of the thrust member 11 will cause axial displacement of the valve stems 7, 8 and thereby cause the valves 1, 2 to move into the open position. Since the axial center line 17 of the thrust member 11 is displaced with respect to the center line 20 of the cam 19, this downward movement will cause the thrust member 11 to be slightly rotated about its axial center line 17. Due to the off-center orientation of the axial center lines 12, 13 of the valve stems 7, 8 with respect to center lines 14, 15, which are indicating the points of engagement with the thrust member 11, this rotary movement of the thrust member 11 will cause slight rotation of the valves 1, 2.

Figure 2:
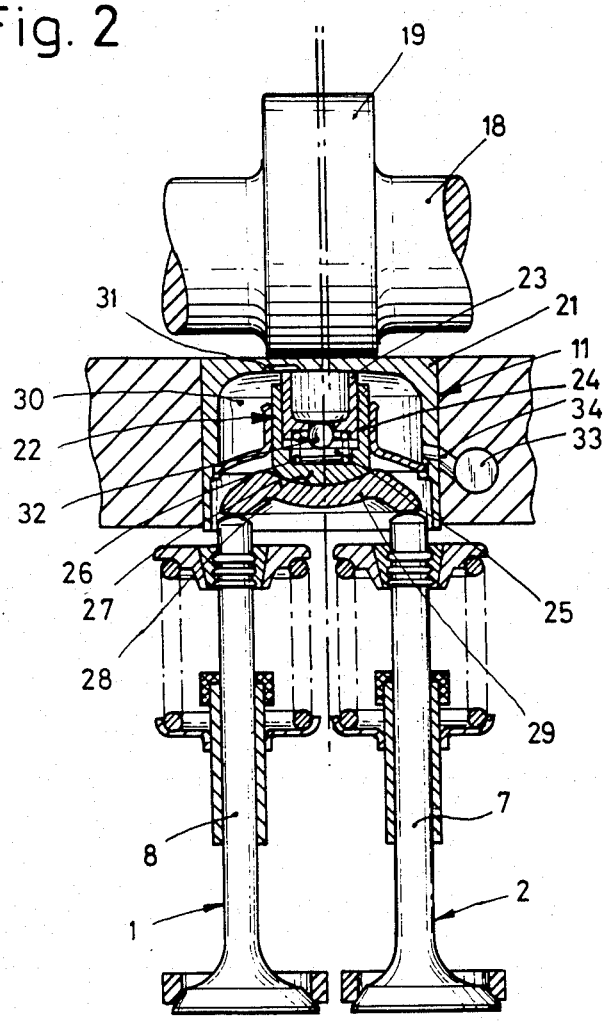
FIG. 2 is a longitudinal section of a second embodiment of he valve mechanism according to the invention.

In the embodiment according to FIG. 2, wherein similar parts are designated by similar reference numerals, the thrust member 11, which is in the form of a bucket-type tappet 21, contains a valve clearance compensating device 22. The valve clearance compensating device 22 is comprised of two pistons 23, 24, with one piston being telescopically fitted inside the other. The two pistons 23, 24 are defining a high-pressure chamber 25 which contains a compression-type coil spring 26 adapted to keep the two pistons in a spaced-apart relationship. The upper piston 23 is in engagement with the inner side of the end wall of the bucket-type tappet 21. The lower piston 24 is provided with a dome-shaped surface 27 which is bearing against a correspondingly contoured cup-shaped surface 28 of a thrust plate 29. Just as in the embodiment described above, the valve stems 7, 8 are in engagement with the thrust plate 29 in such a manner that rotation of the thrust plate 29 will cause rotation of the valve stems 7, 8 and, as in the same embodiment described earlier, rotation of the bucket-type tappet 21 relative to the thrust plate 29 is being effected in that the cam 19 is engaging the bucket-type tappet 21 off-center, and in that the rotary movement of the tappet 21 is being transmitted by way of the valve clearance compensating device 22 relative to the thrust plate 29.

As far as the operation of the valve clearance compensating device 22 is concerned, it should be mentioned that between the inner peripheral surface of the bucket-type tappet 21 and the outer peripheral surface of the valve clearance compensating device 22 there is arranged an oil reservoir chamber 30 from which oil is enabled to pass through an opening in the inner end face of the tappet 21 and into the upper piston 23. From there, fluid flow into the high-pressure chamber 25 is controlled by a check valve 32. The oil reservoir chamber 30 is supplied with hydraulic fluid by way of a bore 33 and a passage 34. The pressure in the high-pressure chamber 25 is being generated by the engine oil pressure and the pumping action of the tappet 21 through the tappet 19. This will enable the pistons 23, 24 to establish a connection between the cam 19 and the valve stems 7, 8 that is free of play.

Figure 3:
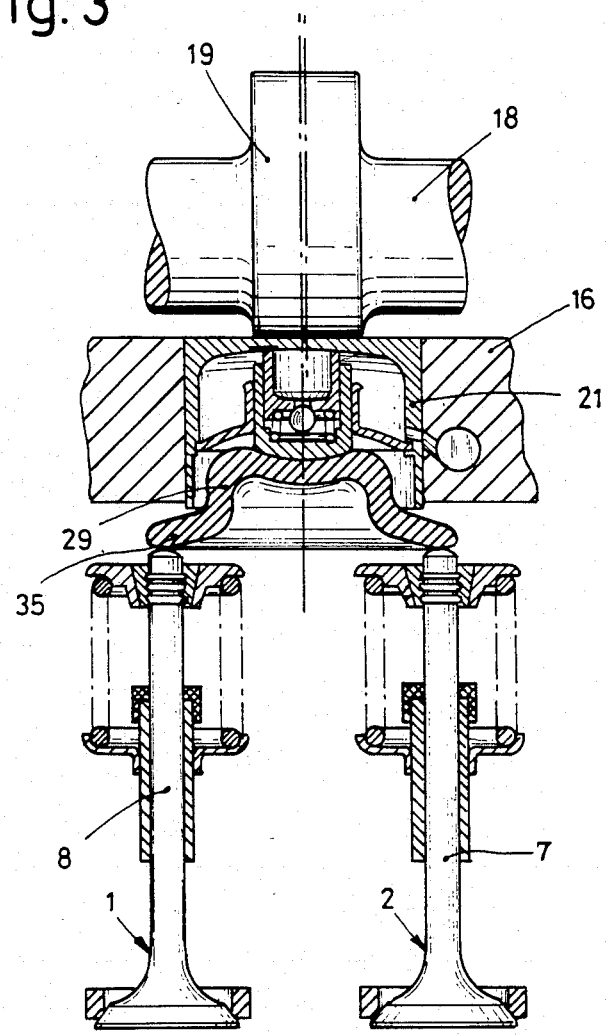
FIG. 3 is a longitudinal section of a third embodiment of a valve mechanism according to the invention.

The embodiment according to FIG. 3, wherein similar parts are designated by similar reference numerals, differs from the one in FIG. 2 in that the thrust element 29 has the shape of a hat when viewed in cross-section, that it has a brim-like edge 35 which extends radially outwardly from the tappet 21, and that its brim-like edge 35 engages the valve stems 7, 8. This arrangement will enable to space the valves apart at a greater distance than would be possible with the arrangement according to FIG. 2.

The embodiments of the invention in which an exclusive property or privilege is claimed are defined as follows:

1. Valve gear for at least two valves of an internal combustion engine to be operated simultaneously on longitudinal axes, wherein the valve gear comprises a thrust device which is common to all valves and displaceable on an axis by a cam shaft and against which the valves abut by their valve stems so that displacement of the thrust device causes corresponding displacement of the valves, characterized in that the camshaft (18) includes a single cam (19) that is seated on the thrust device (11) eccentrically relative to its axis (17) causing rotation of the thrust device (11) about its axis (17) when the thrust device (11) is displaced, the thrust device (11) is axially symmetrical, and the valve stems (7,8) each abut against the thrust device (11) at positions centered on points offset from the longitudinal axes (12, 13) of the valves causing rotation of the valves (1,2) about their longitudinal axis (12, 13) when the valves are displaced.

2. Valve gear including a hydraulic play-compensating device for at least two valves of an internal combustion engine to be operated simultaneously on longitudinal axes, wherein the valve gear comprises a thrust device which is common to all valves and displaceable on an axis by a camshaft and against which the valves abut by their valve stems, characterized in that the camshaft (18) includes a single cam (19) that is seated on the thrust device (11) eccentrically relative to its axis (17), the thrust device (11) is axially symmetrical, the valve stems (7,8) each abut against the thrust device (11) at positions centered on points offset from the longitudinal axes (12, 13) of the valves, and the thrust device (11) includes a cup tappet (21) operatively located for abutment against the cam (19) of the camshaft (18) said cup tappet being guided axially in a wall (16) of the engine, a thrust piece (29) operatively located in said cup tappet (21), and a tappet clearance compensator (22) operatively positioned between the cup tappet (21) and the thrust piece (29), and wherein said thrust piece (29) has a central spherical segment-shaped surface (28) for abutment against a corresponding spherical segment surface (27) of said tappet clearance compensator (22).

3. Valve gear according to claim 2, characterized in that said tappet clearance compensator (22) comprises an assembly of two telescopic skirted-type pistons (23, 24) between which there is defined a high-pressure chamber (25) and of which the upper piston abuts against an inner face of the cup tapper (21) and the lower piston has a spherical segment surface (27) for abutment against said thrust piece (29), and between the outer side of the skirted-piston assembly and the interior of the cup tappet (21) is formed an oil reservoir (30) which communicates via a non-return valve (32) with the high-pressure chamber (25) between the skirted-type pistons (23, 24).

4. Valve gear according to claim 2, characterized in that the thrust piece (29) is hat-shaped, and has a brim-like edge (35) that protrudes radially from the cup tappet (21) and is seated on the valve stems (7, 8).

* * * * *